US005261954A

United States Patent [19]

Collings

[11] Patent Number: 5,261,954

[45] Date of Patent: Nov. 16, 1993

[54] AUTHENTICATABLE SECURITY PAPER AND AUTHENTICATING COMPOSITION THEREFOR

[75] Inventor: Peter Collings, High Wycombe, England

[73] Assignee: The Wiggins Teape Group Limited, Hampshire, England

[21] Appl. No.: 973,744

[22] Filed: Nov. 9, 1992

Related U.S. Application Data

[62] Division of Ser. No. 493,344, Mar. 14, 1990, Pat. No. 5,188,871.

[30] Foreign Application Priority Data

Mar. 14, 1989 [GB] United Kingdom ..... 8905810
Apr. 21, 1989 [GB] United Kingdom ..... 8909134

[51] Int. Cl.[5] ..... C09D 11/00; D21H 21/44; B44F 1/10

[52] U.S. Cl. ..... 106/21 A; 106/21 K; 106/21 C; 427/7; 162/140; 283/114

[58] Field of Search ..... 106/21 A, 21 R, 21 C; 427/7; 162/140; 283/114

[56] References Cited

U.S. PATENT DOCUMENTS

| | | | |
|---|---|---|---|
| 302,758 | 7/1884 | Menzies | 162/140 |
| 531,507 | 12/1894 | Caryalho | 162/140 |
| 3,632,364 | 1/1972 | Thomas et al. | 106/21 C |
| 3,638,335 | 1/1972 | Gunderson et al. | 427/288 |
| 3,663,243 | 5/1972 | Stryker et al. | 106/21 R |
| 3,788,863 | 1/1974 | Scheuer | 106/21 C |
| 5,017,226 | 5/1991 | Kulsiz | 106/21 C |

*Primary Examiner*—Helene Klemanski
*Attorney, Agent, or Firm*—Burns, Doane, Swecker & Mathis

[57] ABSTRACT

A security paper authenticating system comprises, in combination, a security paper carrying both starch and an iodate salt, typically potassium iodate, and an authenticating composition comprising an acidic solution of an iodide salt, typically potassium iodide, the system being such that on applying the authenticating composition to authentic security paper, as by a pen, brush or stamp pad, iodine is generated and a characteristic starch-iodine coloration is produced. The authenticating composition is preferably aqueous or part-aqueous, and is preferably made acidic by means of a weak organic acid such as tartaric acid. The authenticating composition preferably also contains an antioxidant such as ascorbic acid. The invention extends to the paper and the authenticating composition individually.

20 Claims, No Drawings

AUTHENTICATABLE SECURITY PAPER AND AUTHENTICATING COMPOSITION THEREFOR

This application is a divisional of application Ser. No. 07/493,344, filed Mar. 14, 1990 now U.S. Pat. No. 5,188,871.

This invention relates to an authenticatable security paper and authenticating composition which together constitute a security paper authenticating system. The invention also extends to the method of authenticating the security paper using the authenticating composition, and to the authenticating composition itself.

By a "security paper" is meant any paper having a value such as to render it potentially liable to attempts at counterfeiting. Typical examples of such papers are papers as conventionally used in security documents, for example: cheques; travellers cheques; money orders; bankers drafts; bearer bonds; share certificates and other certificates; stamps; postal orders; identity documents; registration documents; driving licences, vehicle road tax licences and other licences or permits; electoral papers; savings or bank account passbooks; passports; lottery tickets; admission tickets; travel tickets; vouchers; coupons; tokens; and shipping and other transport documents; in banknotes; and as the signature panels for credit cards, cheque guarantee cards, bank cards or identity cards.

It is desirable that the authenticity of the paper used in at least certain types of security document should be easily verifiable by people to whom such documents may be presented, for example a clerk at a bank, post office or airline check-in counter, or a ticket collector at a sports stadium, theatre or other auditorium. Such verification must be quick and easy, and not necessarily reliant on sophisticated equipment of the kind only available in a laboratory. Desirably, however, the authenticating system should also be capable of use in an automatic verification system, for example involving an inking mechanism followed by an optical image detector.

Papers for use in labels or distinctive packaging may also be subject to counterfeiting particularly if they bear a manufacturer's name and/or a brand name. Considerable publicity has been given in recent years to the problems of illegal marketing of cheap copies of branded goods, for example car brake pads, and prestigious brands of wristwatch or clothing, and of illegal copying of pre-recorded music cassettes, records or videotapes or of computer programs. The copies are liable to be packaged and branded in much the same way as genuine goods from an original or authorised manufacturer. Thus the use of verifiable or authenticatable paper in the labels and/or packaging of the goods provides a means of checking the authenticity of branded goods. Verifiable or authenticatable label or packaging paper is therefore within the ambit of the term "security paper" as used in this specification.

It has previously been proposed to meet the above-described need for easy manual verification by incorporating in the paper a chemical reagent which on being contacted by an authenticating composition will produce a characteristic color (or color change). The authenticating composition may be applied, for example, by means of a pen or a stamp pad. Examples of proposals of this nature may be found in U.S. Pat. Nos. 3,001,887 and 3,523,866 and British Patent No. 1,507,454.

Numerous color-generating or color-changing reactions are known, and potentially therefore, there are a large number of color-generating or color-changing authenticating systems available for use with security papers as described above. In practice however, very few such systems have been commercialized. The reasons for this are thought to be one or more of the following:

- the color-generating or -changing reaction is too slow or will not take place at all in the medium of a sheet of paper;
- the chemicals involved are unacceptable for safety or environmental reasons;
- the chemicals involved are too costly for the authenticating system to be economic;
- the chemical required to be incorporated in the paper adversely affects the color or appearance of the paper, either because the chemical is itself colored or because it discolors with time;
- the chemical required to be incorporated in the paper is incompatible with normal papermaking chemicals (e.g. alum, sizing agents, or retention aids);
- the color-generating reaction is dependent on precisely controlled or extreme reaction conditions which are not readily achievable in practice; and
- the color generated by the authenticating reaction is aesthetically unappealing.

It is an object of the present invention to provide an improved security paper authenticating system which both facilitates easy authentication by either manual or automatic means and avoids or minimizes the above-described drawbacks.

We have now discovered that the above object can be achieved by incorporating starch and an iodate salt, preferably potassium iodate, in the paper and using an acidic solution of an iodide salt, preferably potassium iodide, as the authenticating composition, preferably with a reducing antioxidant also present. Iodine is liberated on contact of the iodate salt and the acidic iodide salt, according to the following reaction:

$$IO_3^- + 5I^- + 6H^+ = 3I_2 + 3H_2O \quad (1)$$

The liberated iodine reacts immediately with the starch to produce the characteristic starch-iodine dark blue/-black coloration.

The use of iodate and iodide salts in combination for the generation of iodine for security purposes is not novel in itself, having been proposed in patents dating from the last century, namely British Patent No. 748 of 1891 and U.S. Pat. No. 302,758, issued in 1884. In both these cases however, iodate and iodide salts, and starch (together with other chemicals) were all proposed to be incorporated in the paper together, as a means of revealing attempts at fraudulent alteration of security documents by means of acids, bleaching fluids or alkalies. Fraudulent alteration with at least certain of these agents would result in liberation of iodine, and hence in the characteristic starch-iodine colouration.

The use of iodate salt (other than in combination with iodide salt) is known for the detection of attempts at fraudulent alteration using proprietary ink eradicators. These typically use reducing agents such as sodium metabisulphite. The reducing agent reduces the iodate to iodine and so produces the starch-iodine coloration on contact with starch also present in the paper.

The use of iodide salt (other than in combination with iodate salt) has also been proposed in a number of early patents, again for the detection of attempts at fraudulent alteration. These patents include British Patents Nos. 13521 of 1851; 1386 of 1856; 7206 of 1909; and 2075 of 1911; and U.S. Pat. Nos. 531,507; 1,269, 863; and 2,123,597.

The present invention is to be contrasted with these earlier proposals in that whereas the iodate and starch are present in the paper, the iodide is added only for authentication purposes. Such authentication of the paper used in a security document is to be contrasted and distinguished from the detection of attempts at fraudulent alteration of material written or printed on security documents using authentic security paper.

Accordingly, the present invention provides in a first aspect a security paper authenticating system comprising, in combination, a security paper carrying both starch and an iodate salt, and an authenticating composition comprising an acidic solution of an iodide salt, the system being such that on applying the authenticating composition to authentic security paper, iodine is generated and a characteristic starch-iodine coloration is produced.

In a second aspect, the present invention provides a method of authenticating a security paper presumed to carry both starch and an iodate salt, wherein an authenticating composition comprising an acidic solution of an iodide salt is applied to the paper, thereby to generate iodine and produce a characteristic starch-iodine coloration if the paper is authentic.

In a third aspect, the present invention provides an authenticating composition for authenticating a security paper presumed to carry both starch and an iodate salt, said composition comprising an acidic solution of an iodide salt, whereby on applying the authenticating composition to the paper, iodine is generated and a characteristic starch-iodine coloration is produced.

The iodate and iodide salts are each preferably potassium salts, although sodium or other metal salts could be used.

The authenticating composition containing the iodide salt solution is normally aqueous, and is preferably rendered acidic by the presence of tartaric acid, but in principle any weak inorganic or organic Brönsted-Lowry acid could be used. Alternatives to tartaric acid, given by way of example only, are maleic, oxalic, malonic, succinic, glutaric, adipic, tricarballylic, diglycolic, lactic, malic, citric, pyrophosphonic, benzene sulphonic, naphthalene-2-sulphonic and 1-phenol-4-sulphonic acids. Whilst strong acids such as sulphuric acid would produce the desired chemical effect, their use would be disadvantageous in view of the corrosive nature of these acids, which would increase as evaporation occurred.

The pH of the authenticating composition should be below about 4, and is preferably in the range of about 2 to about 2.5. When tartaric acid is used as the acidifying agent, the concentration of tartaric acid is preferably in the range of about 0.1 to 100 g $l^{-1}$, more preferably about 10 g $l^{-1}$.

The solvent for the authenticating composition may be water or a mixture of water and one or more miscible co-solvents, for example, 2-ethoxyethanol, glycerol or diethylene glycol, with the co-solvent being present in an amount of up to about 80% by weight.

The potassium iodide concentration in the authenticating composition may vary widely, for example from 0.1 to 100 g $l^{-1}$, but preferably is about 10 g $l^{-1}$.

The authenticating composition preferably contains an antioxidant, in order to prevent gradual oxidation of the iodide to iodine by atmospheric oxygen, which would lead to discoloration of the authenticating composition.

The preferred antioxidant is ascorbic acid. However, the amount of ascorbic acid used must not be too great if the color generating reaction is not to be adversely affected. This is because ascorbic acid will itself react with the iodate in the paper:

$$2IO_3^- + 12H^+ + 5C_6H_8O_6 = I_2 + 7H_2O + 5C_6H_6O_6 \quad (2)$$

This reaction (2) produces only 0.5 mole $I_2$ per mole $IO_3^-$, whereas the primary iodine-producing reaction (1) produces 3 mole $I_2$ per mole $IO_3^-$. In order to maximise the quantity of iodine generated, and thus to maximise the intensity of the authenticating starch-iodine coloration, it is necessary to choose the amounts of iodide salt and ascorbic acid antioxidant in the authenticating composition so as to favour reaction (1) and inhibit reaction (2), i.e. to employ a relatively high concentration of iodide salt and a relatively low concentration of ascorbic acid. In practice, a potassium iodide concentration of about 10 g $l^{-1}$ and an ascorbic acid concentration of about 1 g $l^{-1}$ have been found optimum, but ascorbic acid concentrations of up to about 3 g $l^{-1}$ may be used.

A further reason for employing a low ascorbic acid concentration is that besides acting as a sacrificial antioxidant for minimizing the harmful effects of atmospheric oxygen by reacting directly with oxygen, excess ascorbic acid may convert iodine generated by reaction (1) back to iodide ions. Whilst this reaction is valuable in the authenticating composition prior to use (since it assists in coping with the potential problem of oxidation of iodide ions by atmospheric oxygen), it is undesirable once the authenticating composition has been applied to paper, as it lessens the color generating effect.

A preferred authenticating composition contains, per liter, 10 g potassium or sodium iodide, 10 g of tartaric acid and 1 g ascorbic acid, preferably with water as the solvent without organic co-solvents.

The iodate salt may be added to the paper during its manufacture, for example as a wet end additive, or at a size bath or size press or by spraying the wet web on the papermachine wire. The preferred iodate salt addition level in such a case is about 0.02% to about 3%, more preferably about 0.2 to 0.3% (based on the total dry weight of the paper in each case).

Alternatively, the iodate salt may be applied to previously formed paper by a coating or printing technique. In the latter case, the printing of the iodate salt may be in the form of a discontinuous pattern. The preferred iodate addition level in the case of coating or printing is in the range of about 0.02 to about 3 g $m^{-2}$, more preferably about 0.2 to 0.3 g $m^{-2}$ (where the iodate is applied in the form of a pattern by a printing operation, these coatweights are applicable to the printed areas only of the paper, and not to the total surface area, i.e. the printed and unprinted areas).

The starch required in the paper may be any of the starches conventionally used in papermaking, and may be applied as a wet-end additive or at a size press or size bath. The level of starch addition may be, for example, 0.1 to 30% (based on the total dry weight of the paper). Alternatively, the starch may be applied by a coating or printing technique, and in the latter case, the printing may be in the form of a discontinuous pattern. In this case, the coatweight of starch applied may be, for example, in the range of about 0.002 to 30 g $m^{-2}$ (where the starch is applied in the form of a pattern by a printing operation, this coatweight is applicable to the printed areas only of the paper, and not to the total surface area, i.e. the printed and unprinted areas).

The authenticating composition may conveniently be applied to paper to be authenticated by means of a felt-tip, fountain or other pen, or by means of a stamp pad. When intended to be applied in such a manner, the authenticating composition can be regarded as an ink. Alternatively, a brush may be used to apply the authenticating composition.

The present invention facilitates ready verification of the authenticity of security paper by non-technical personnel using everyday equipment such as pens, stamp pads or brushes. Equally however, the invention is capable of application in an automatic verification system, for example involving an inking mechanism followed by an optical image detector. The chemicals used are readily available and cheap, and the verification reaction is fast. Furthermore, the dark blue/black color generated is characteristic and so different from the colours relied upon by previously proposed authenticating systems that confusion between systems is impossible or at least very improbable.

The invention will now be illustrated by reference to the following Examples:

EXAMPLE 1

White paper of 95 g $m^{-2}$ target grammage and containing both starch and potassium iodate was made on a Fourdrinier paper machine in conventional manner. The starch and the potassium iodate were incorporated at two different levels by size press addition. The size compositions were made up by the addition of 300 g and 600 g respectively of potassium iodate to 100 l of 7% by weight starch solution. The dry pick up of starch was approximately 3 g $m^{-2}$ and that of potassium iodate was approximately 0.12 or 0.24 g $m^{-2}$ respectively, i.e. 0.13 or 0.25% by weight, based on the dry weight of the paper.

Samples of both papers were then tested by the application of the following authenticating composition by means of an applicator pen.

| Ingredient | Concentration (g $l^{-1}$) | Solvent |
|---|---|---|
| potassium iodide | 10 | Water |
| tartaric acid | 10 | |
| ascorbic acid | 1 | |

An immediate strong blue-black coloration was produced with the paper with the higher level of potassium iodate, and a slower and less intense, but still acceptable, blue-black coloration with the lower level of potassium iodate.

EXAMPLE 2

This illustrates the effect of varying the concentration of potassium iodide in the authenticating composition. The paper tested was as described in Example 1. Three different authenticating compositions were made up, each of which was as described in Example 1 except for the potassium iodide concentrations, which were 1, 0.1 and 20 g $l^{-1}$. It was found that the effect of lowering the potassium iodide concentration was to delay the formation of the coloration and to reduce its intensity, i.e. its blackness. Thus whereas the 20 g $l^{-1}$ potassium iodide composition produced an immediate blue-black coloration, the 1 g $l^{-1}$ composition produced a blue coloration after about a second, and the 0.1 g $l^{-1}$ composition a blue coloration after about 3 to 5 seconds.

EXAMPLE 3

This illustrates the effect of varying the concentration of tartaric acid in the authenticating composition. The paper tested was as described in Example 1. Six different authenticating compositions were made up, each of which was as described in Example 1 except for the tartaric acid concentrations, which were 0.1; 0.2; 0.5; 0.8; 1 and 20 g $l^{-1}$. It was found that for tartaric acid concentrations up to 0.5 g $l^{-1}$, no blue or blue-black coloration was produced, but that at 0.8 $gl^{-1}$ and greater concentrations, an immediate blue-black coloration was produced.

EXAMPLE 4

This illustrates the use of acids other than tartaric acid as acidifying agents. The acids used were citric acid and benzene sulphonic acid, both at a concentration of 10 g $l^{-1}$ and sulphuric acid at a concentration of 1 g $l^{-1}$. The authenticating composition was otherwise as described in Example 1, and the paper tested was also as described in Example 1. It was found that all three compositions produced an immediate blue-black coloration, so demonstrating that the acids other than tartaric acid can be used in the authenticating composition. As mentioned previously, sulphuric acid would not normally be used in practice because of its corrosive nature.

EXAMPLE 5

This illustrates the effect of omitting ascorbic acid antioxidant from the authenticating composition, and of replacing ascorbic acid by gallic acid. Paper as described in Example 1 was tested firstly with an authenticating composition as described in Example 1 except for the omission of ascorbic acid, and secondly with an authenticating composition comprising gallic acid at a target concentration of 10 g $l^{-1}$ as the acidifying agent and tartaric acid at a concentration of 1 g $l^{-1}$ as an antioxidant. The solvent used was water. There was difficulty in getting all the gallic acid to dissolve, and the target concentration was not achieved. Both authenticating compositions produced an immediate blue-black coloration, but it was noticed that the unused authenticating composition turned yellow after one day (first composition with no antioxidant) or two days (second composition with tartaric acid antioxidant). No such yellow coloration was observed with authenticating compositions including ascorbic acid.

EXAMPLE 6

This illustrates the use of an authenticating composition containing an organic cosolvent, namely 2-ethoxy ethanol, in 50/50 v/v mixture with water. The authenticating composition was otherwise as described in Example 1, (although there was difficulty in getting all the solutes to dissolve). When this composition was tested on the paper described in Example 1, an immediate dark brown coloration was produced.

EXAMPLE 7

This illustrates the use of alternative iodide salts in the authenticating composition in place of potassium iodide.

Two authenticating compositions were prepared each of which was as in Example 1 except that in one case sodium iodide was used and in the other zinc iodide, both at a concentration of 10 g $l^{-1}$. Both compositions gave an immediate blue-black coloration when applied to paper as described in Example 1.

EXAMPLE 8

This illustrates the use of sodium iodate in the authenticatable paper in place of potassium iodate, and also the incorporation of the starch and the iodate in the paper by a coating technique rather than by inclusion in the furnish from which the paper is made.

A 3% by weight aqueous solution of starch was made up, and 0.1 g and 0.2 g additions respectively of sodium iodate were added to 100 $cm^3$ portions of this starch solution. The resulting compositions were each coated on to white 80 g $m^{-2}$ bond papers at approximate coat-weight (when dry) of 3 g $m^{-2}$. Authenticating compositions as described in Examples 1 (potassium iodide) and 7 (sodium iodide and zinc iodide) were applied to the resulting papers. In all cases, an immediate blue-black coloration was produced.

EXAMPLE 9

The authenticating solutions described in the previous Examples were stored for a period of six weeks, and then reapplied to the papers described above. The same results were obtained. No discoloration of the authenticating compositions was observed, beyond that as already mentioned in Example 5.

I claim:

1. An authenticating composition for authenticating a security paper carrying both starch and an iodate salt, wherein said composition comprises an acidic solution of an iodide salt and is rendered acidic by the presence of a weak acid selected from the group consisting of tartaric acid, maleic acid, oxalic acid, malonic acid, succinic acid, glutaric acid, adipic acid, tricarballylic acid, diglycolic acid, lactic acid, malic acid, citric acid, pyrophosphonic acid, benzene sulphonic acid, naphthalene-2-sulphonic acid, and 1-phenol-4-sulphonic acid, wherein said iodide salt and weak acid are present in the authenticating composition in amounts whereby on applying the authenticating composition to the paper, iodine is generated and a characteristic starch-iodine coloration is produced.

2. An authenticating composition as claimed in claim 1, wherein the pH of the composition is not more than 4.

3. An authenticating composition as claimed in claim 1, comprising a weak organic acid.

4. An authenticating composition as claimed in claim 3 wherein the acid is tartaric acid.

5. An authenticating composition as claimed in claim 1, comprising an antioxidant.

6. An authenticating composition as claimed in claim 5, wherein the antioxidant is ascorbic acid.

7. An authenticating composition as claimed in claim 1, comprising an aqueous solution of potassium iodide, tartaric acid and ascorbic acid.

8. An authenticating composition as claimed in claim 7, wherein the concentrations are as follows:
potassium iodide 10 g $l^{-1}$;
tartaric acid 10 g $l^{-1}$; and
ascorbic acid 1 g $l^{-1}$.

9. An authenticating composition as claimed in claim 2, comprising an antioxidant.

10. An authenticating composition as claimed in claim 9, wherein the antioxidant is ascorbic acid.

11. An authenticating composition as claimed in claim 2, comprising an aqueous solution of potassium iodide, tartaric acid and ascorbic acid.

12. An authenticating composition as claimed in claim 11, wherein the concentrations are as follows:
potassium iodide 10 g $l^{-1}$;
tartaric acid 10 g $l^{-1}$; and
ascorbic acid 1 g $l^{-1}$.

13. An authenticating composition as claimed in claim 3, comprising an antioxidant.

14. An authenticating composition as claimed in claim 13, wherein the antioxidant is ascorbic acid.

15. An authenticating composition as claimed in claim 3, comprising an aqueous solution of potassium iodide, tartaric acid and ascorbic acid.

16. An authenticating composition as claimed in claim 15, wherein the concentrations are as follows:
potassium iodide 10 g $l^{-1}$;
tartaric acid 10 g $l^{-1}$; and
ascorbic acid 1 g $l^{-1}$.

17. An authenticating composition as claimed in claim 4, comprising an antioxidant.

18. An authenticating composition as claimed in claim 17, wherein the antioxidant is ascorbic acid.

19. An authenticating composition as claimed in claim 4, comprising an aqueous solution of potassium iodide, tartaric acid and ascorbic acid.

20. An authenticating composition as claimed in claim 19, wherein the concentrations are as follows:
potassium iodide 10 g $l^{-1}$;
tartaric acid 10 g $l^{-1}$; and
ascorbic acid 1 g $l^{-1}$.

* * * * *